US005407230A

United States Patent [19]

Brink et al.

[11] Patent Number: 5,407,230

[45] Date of Patent: Apr. 18, 1995

[54] PRINT FOLDER

[75] Inventors: Thomas J. Brink, Conover, N.C.; Jack B. Keable, Hiltonhead, S.C.

[73] Assignee: Waldorf Corporation, St. Paul, Minn.

[21] Appl. No.: 100,570

[22] Filed: Jul. 30, 1993

[51] Int. Cl.[6] ..... B42D 1/00

[52] U.S. Cl. ..... 281/15.1; 281/21.1; 281/29; 281/31

[58] Field of Search ..... 281/15.1, 21.1, 29, 281/30, 37, 31, 48; 402/70, 73, 75, 78; 40/359; 493/947; 229/82, 84

[56] References Cited

U.S. PATENT DOCUMENTS

| | | | |
|---|---|---|---|
| 1,529,264 | 3/1925 | Mayers | 40/359 |
| 3,210,093 | 10/1965 | Steidinger | 281/21.1 |
| 3,267,980 | 8/1966 | Bird | 281/30 X |
| 3,966,113 | 6/1976 | Tipton | 229/84 X |
| 4,219,951 | 9/1980 | Schmidt | 40/359 X |
| 4,793,758 | 12/1988 | Hanson et al. | 281/21.1 |
| 4,898,405 | 2/1990 | Pickering et al. | 281/29 |

FOREIGN PATENT DOCUMENTS

| | | | |
|---|---|---|---|
| 232882 | 6/1925 | United Kingdom | 40/359 |

*Primary Examiner*—Willmon Fridie

*Attorney, Agent, or Firm*—Schwegman, Lundberg & Woessner

[57] ABSTRACT

The present invention is a folder, particularly adapted for containing and viewing photographic prints or the like. The folder includes a front cover and a rear cover foldably connected to the front cover at a spine or binding area. The folder includes an integral interior pocket and selectively releaseable closure. The binding area includes adhesive securing means for removably securing the contents in the folder. The invention also encompasses a flat blank for forming the folder.

10 Claims, 4 Drawing Sheets

PRINT FOLDER

TECHNICAL FIELD

The present invention relates to folders, portfolios or the like. More particularly it relates to a folder for containing and viewing photograph, i.e. prints, wherein the folder includes an integral securing means for securing the prints in the folder and a reusable closure.

BACKGROUND OF THE INVENTION

U.S. Pat. No. 4,991,767 (to Wyant) discloses a portfolio having a front cover, a rear cover hingedly connected to the front cover and an inner pocket for securing items such as paper sheets within the folder. The Wyant portfolio is adapted to display photographs by being provided with a transparent film overlaying cut-out sections in the front cover. There is no suggestion in the Wyant patent about how to provide a lockable reclosure means to hold the portfolio closed to protect the contents, nor does the Wyant portfolio provide any means for viewing a series of photographs arranged in manner similar to the pages of a book. U.S. Pat. No. 1,774,215 (to Weinthrop) discloses a somewhat similar display folder, but again, there is no disclosure of a closure for holding the folder closed, and the Weinthrop folder does not include a way to mount photographs or the like in a page-like arrangement.

U.S. Pat. No. 5,060,847 (to Angus) discloses a fairly typical film processing envelope including generally rectangular back and front panels, a closure flap secured to the back panel and a relatively shallow open-top pouch. The contents, developed film or negatives, must be removed from the envelope in order to be viewed. While the Angus reference discloses that a closure flap may be provided so that the envelope can be reclosed, the flap includes a repositionable adhesive which, in time, may tend to loose its adhesive qualities, creating the danger that the contents may fall out of the envelope. The Angus-type envelopes generally may not be durable enough for long-term storage and reuse.

Other arrangements for containing and viewing photographs are disclosed in U.S. Pat. Nos. 5,038,503 (to Goldberg) and 4,275,517 (to Blanchard). The Goldberg assembly is an "accordion" arrangement wherein a number of photographic prints are arranged in edge to edge relationship for receipt in a carton container or box. The Blanchard invention comprises a photographic mount including a frame and a cover hinged to the frame, but it is only capable of mounting a single photograph for viewing and there is no recloseable locking feature disclosed.

U.S. Pat. No. 3,734,396 (to Cowen) discloses a ticket envelope having a front panel, a rear panel and a ticket-receiving pocket, but there is no disclosure of a binding means nor a releaseably lockable closure.

Of course, tab and tab-receiving slot closures are known and are well represented by U.S. Pat. No. 924,094 (to Myers) and the closure for a flexible receptacle as disclosed in U.S. Pat. No. 2,281,452 (to Ottinger). Such tab and slot closures are useful, but there is no suggestion in either of these two references about adapting such closures to a portfolio-like folder for viewing or displaying a series of photographs. U.S. Pat. No. 1,114,596 (to Dustan) discloses a loose-leaf holder including a tab arrangement to hold together the blank sections forming the holder; but there is no suggestion about how to provide a book-like spine or binding arrangement.

U.S. Pat. Nos. 3,933,294 and 4,109,850 (both to Meenan et al.) disclose a one-piece file folder with a rigid spine. While the '850 patent discloses a pocket for containing papers, including a locking tab for slidably expanding or contracting the pocket according to the amount of papers added to the pocket or taken therefrom, there is no suggestion about how to mount plurality of photographs in a page-like manner for viewing, nor is there a suggestion about providing a reusable, releaseably lockable closure for holding the file folders closed.

While all the above-noted patents represent improvements in portfolios and folders, certain problems associated with containing and viewing photographs or prints are not addressed.

One such problem is that a folder for containing a valuable photographic prints should be able to be secured in a closed position, yet be openable easily and conveniently. Once opened, the folder should allow a viewer to view a series of photographs conveniently, ideally in a page or leaf-like manner. It would also be preferable that the prints could be removed from the folder and replaced therein without damage, and that negatives from which the prints are developed could be safely contained in the same folder.

Accordingly, a recloseable folder for containing and viewing photographs, prints or the like, which is easy to open and lockably reclose and which adequately protects the contents yet allows the removal and replacement of the contents, would be a decided improvement over known folders or portfolios.

SUMMARY OF THE INVENTION

The present invention is a folder, particularly adapted for containing and viewing photographs, prints or the like. The folder includes a front cover and a rear cover foldably connected to the front cover at a spine or binding area. The folder includes an integral interior pocket and recloseable clasp. The binding area includes adhesive securing means for removably securing the contents in the folder.

The invention also encompasses a flat blank that may be folded and secured into the preceding folder configuration. The blank may be made from the suitable caliper of paperboard or other suitable material.

To form the blank into its folder configuration, the interior pocket forming panel thereof is folded inwardly to overlie the rear panel. Next, a pair of structural support panels associated with a free edge of the front cover panel are folded inwardly to strengthen the front cover panel and to form a rolled folder edge. The structural panels carry the base of the clasp which is formed by two parallel nicked-out cuts. The clasp receiving keyway or slit is located along the fold line associated with the interior pocket forming flap. A double-sided adhesive tape, or other suitable adhesive, is applied to the spine or binding region located between the front and rear cover panels.

In use, the folded-up blank is provided in a generally flat condition, and a film processor or user removes the release layer from the double-sided tape along the spine, places the edge of the intended contents against the tape and then folds the front and rear panels together. Prior to folding the front panel over the intended contents, now held in place by the adhesive along the spine, the clasp is freed from the front panel by lifting outwardly, breaking the nicks in the cut lines. The covers can then be closed and the clasp removably inserted in the clasp receiving slit. Negatives or other material associated with the photographs or prints such as identifications may be placed in the interior pocket prior to closing the cover.

An object of the present invention is to provide a durable, recloseable folder for containing delicate photographs or prints wherein the contents can be stored in the folder, viewed conveniently without removal, and removed and replaced without damage.

Another object of the present invention is to provide a lockably recloseable package that is easy to open and reclose yet permits the transport, storage, organization, and display or viewing of prints and print negatives conveniently.

An advantage of the present invention is that it adequately protects photographic materials, prints or the like, allows prints and print negatives to be kept together and facilitates arranging prints or photographs in a book-like fashion by date or occasion.

Another advantage of the present invention is that the contents, i.e., photographs, can be inserted easily, removed without damage, and reinserted at any time.

Other objects and advantages of the present invention will become more fully apparent and understood with reference to the following specification and to the appended drawings and claims.

DETAILED DESCRIPTION OF THE PREFERRED EMBODIMENT

Figure 4:
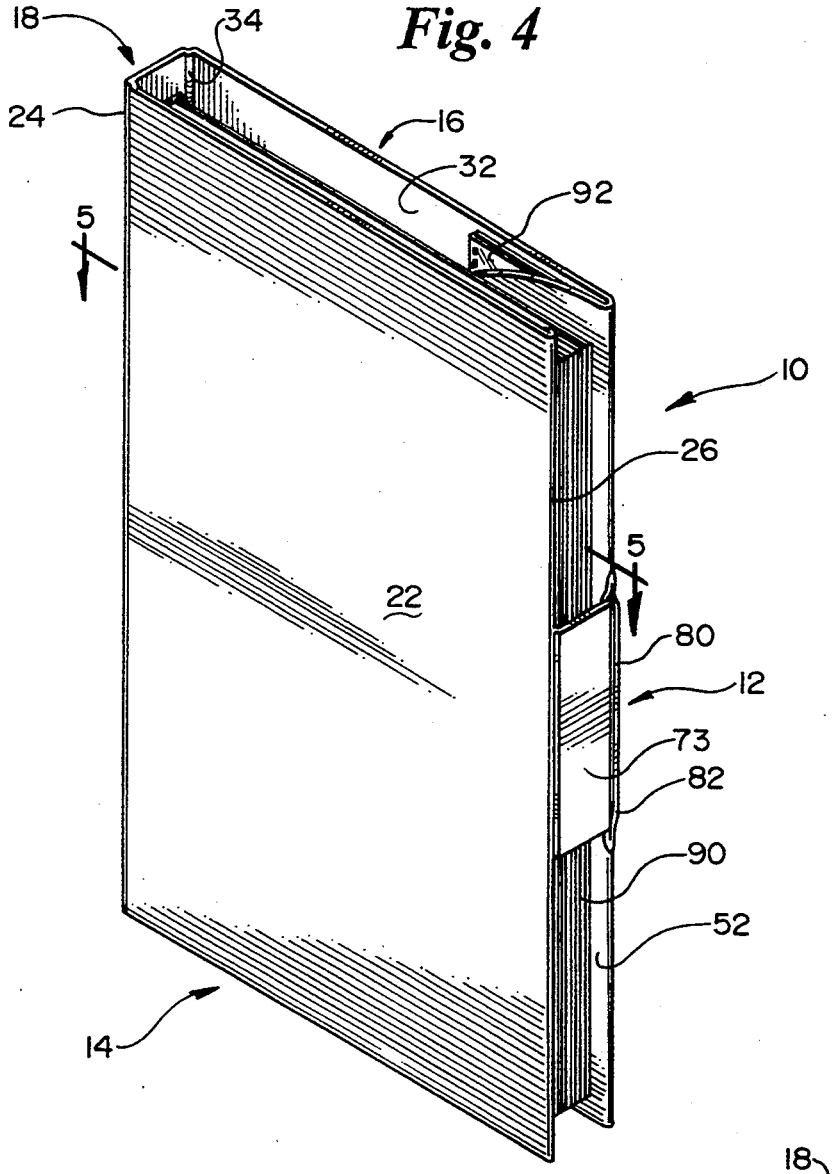
FIG. 4 is a perspective view depicting the present invention fully formed, with contents in place, and lockably closed.
Figure 5:
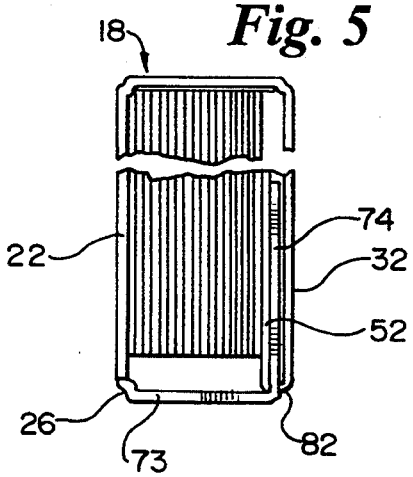
FIG. 5 is a cross-sectional view of the present invention taken along line 5—5 of FIG. 4.

As best seen in FIG. 4, a completed book-like folder 10 in accordance with the present invention includes a relockable closure 12, a front cover 14, a rear cover 16, and a binding or spine region 18. The contents of the folder 10 are received and held in the folder 10 in a page-like configuration.

Figure 1:
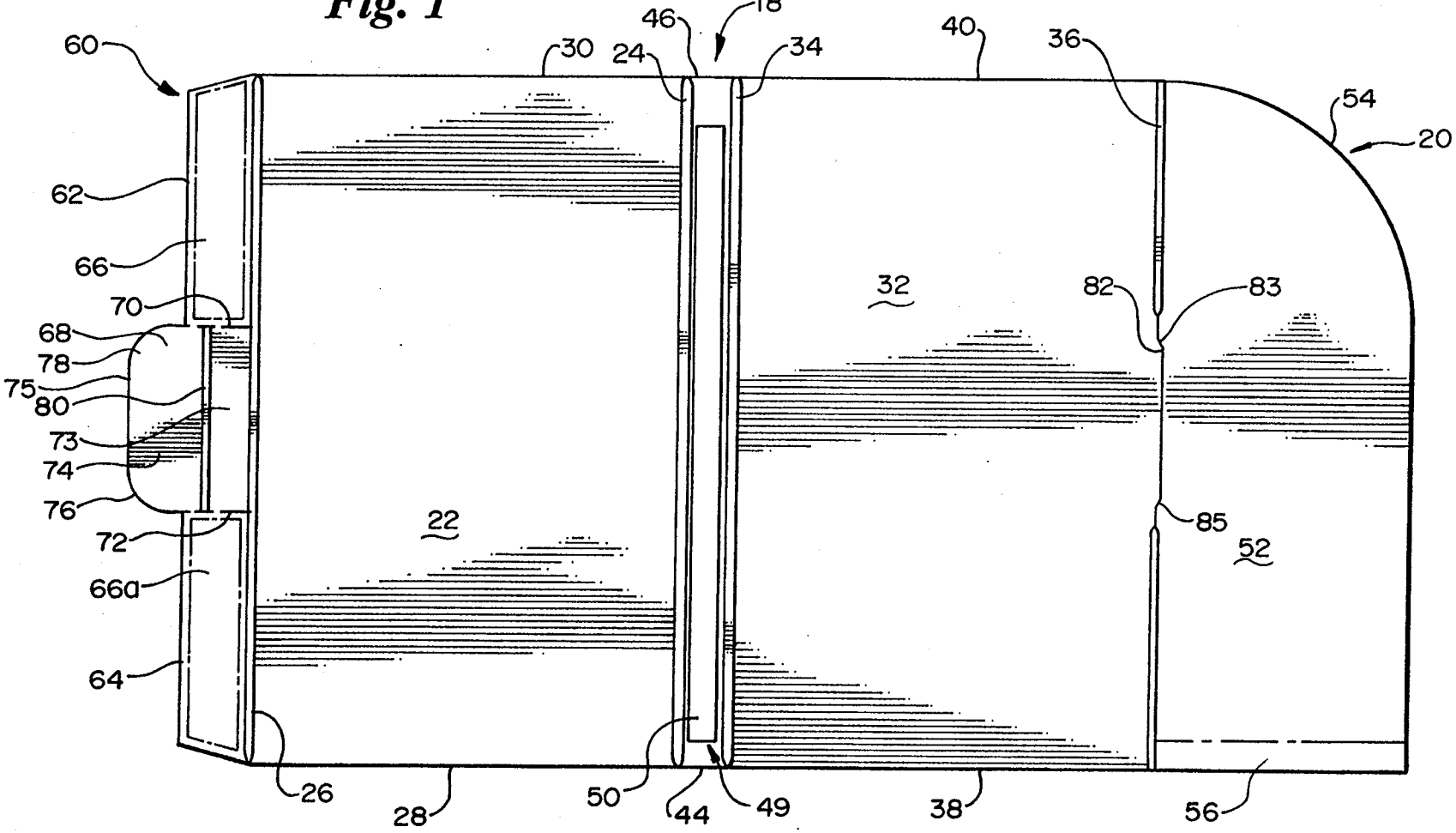
FIG. 1 is a plan view of the blank from which the folder of the present invention is formed, and shows the die cut profile thereof.

FIG. 1 depicts the inside surface of a blank 20 forming, in accordance with the present invention, the folder 10 depicted in FIG. 4. In the drawings, double lines indicate scores to used to form fold lines. Single solid lines indicate cuts or free edges, except where otherwise indicated.

The blank 20 has a generally rectangular front wall forming panel 22 having two opposed edges defined by fold lines 24, 26, a bottom free edge 28 and a top free edge 30.

A generally rectangular rear cover forming panel 32 substantially corresponds in size and surface area to the front cover forming panel 22. The rear cover forming panel 32 is defined by two opposed parallel fold lines 34, 36, a bottom free edge 38 and a top free edge 40. The fold line 34 is generally parallel to the fold line 24, but spaced therefrom.

The binding or spine area 18 is defined by the parallel fold lines 24, 34 and by a bottom free edge 44 and a top free edge 46. The fold lines 24, 34 are spaced apart from each other a predetermined distance to accommodate a double-sided adhesive tape 49 therebetween. The tape is of the type represented by that denoted "tesafix 4959", manufactured by tti of New Rochelle, N.Y. The tape includes a removable release-layer 50.

An interior pocket forming panel 52 is foldably connected to the rear cover forming panel 32 along the fold line 36. The pocket forming panel 52 is co-extensive with the rear cover forming panel 32 along the fold line 36 and includes a rounded corner region 54. The pocket forming panel 52 carries an adhesive region 56 at its bottom edge.

A reinforcing structural panel, indicated generally at 60, is foldably connected to the front cover forming panel 22 along the fold line 26. The structural panel is substantially co-extensive with the length of the fold line 26 and includes an upper panel 62 and a lower panel 64, each carrying an adhesive region 66, **66*a*, respectively. The adhesive regions 56, 66, 66*a*** may be an activatable adhesive or a contact-type adhesive.

Between the upper and lower structural panels 62, 64, the front cover forming panel 22 carries a male clasp tab 68. The clasp tab 68 is foldably connected to the front cover forming panel 22 at fold line 26, and is defined by a pair of parallel nicked-out cut lines, an upper cut line 70 and a lower cut line 72. Alternatively, the cut lines 70, 72 can extend completely through the edges of the tab 68. The tab 68 has a base region 73, a tongue 74 and a leading edge 75, generally parallel to the fold line 26, with rounded corners 76, 78. A short flexure fold line 80 extends across the width of the tab 68 and is generally parallel to the fold line 26. The fold line 80 is spaced from the fold line 26 a distance approximately equal to the distance between the fold lines 24, 34. Another component of the reclosure clasp 12 is a female tab receiving slit 82. The slit 82 is generally co-linear with the fold line 36 between the pocket forming panel 52 and the rear cover forming panel 32. The slit 82 has tapered ends 83, 85 formed by non-colinear terminal regions of the slit 82 to facilitate locking the folder 10 and, like the tab 68, is generally centered between the upper and lower free edges of the blank 20.

Figure 2:
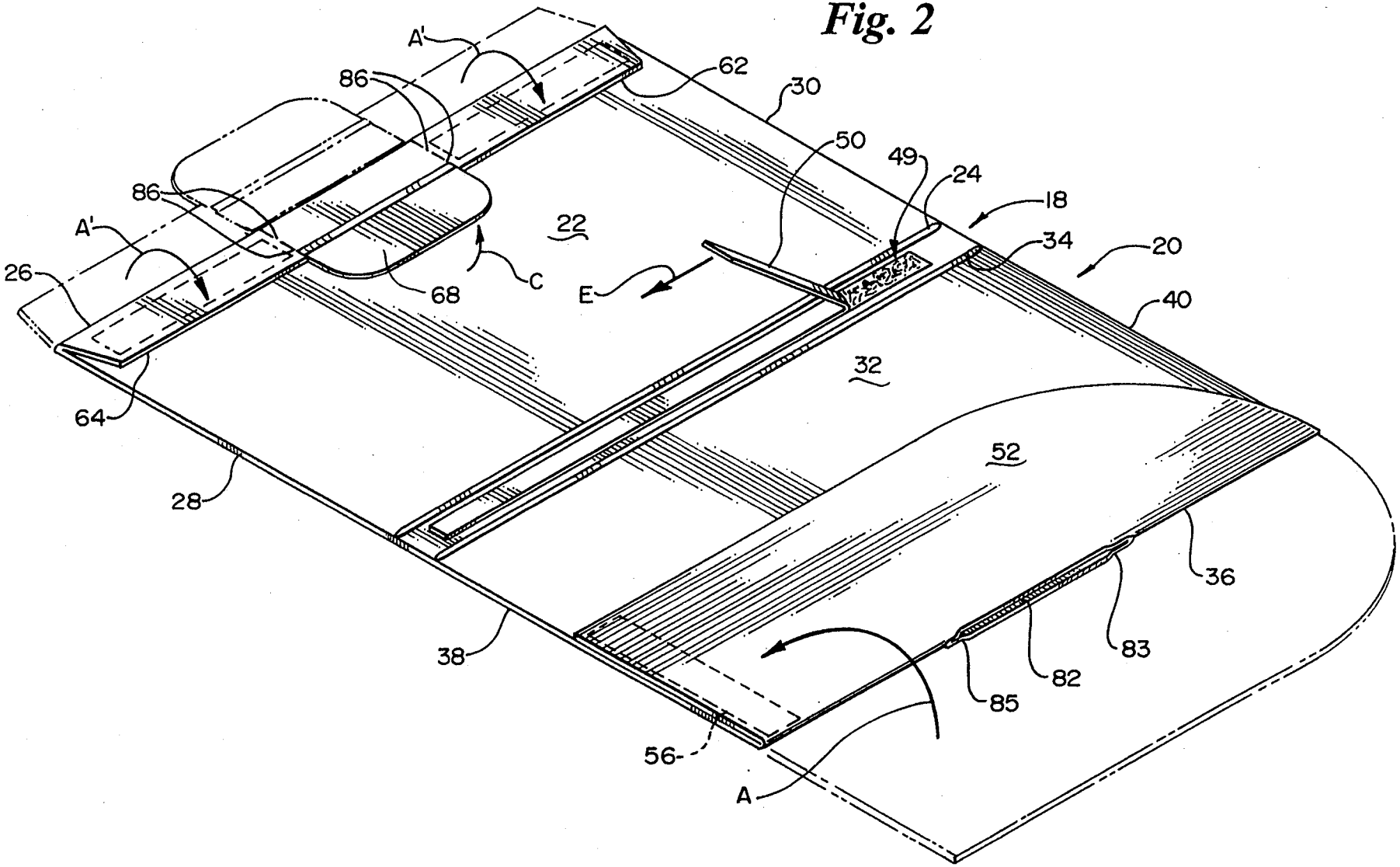
FIG. 2 is a perspective view of the present invention showing the fold up of the blank and the preparation of the folder of the present invention for receiving contents.

FIG. 2 depicts the fold up or forming sequence for forming the blank 20 into the folder 10. First, 180 degree folds are made at fold lines 36 and 26, in the direction of arrows A and A', respectively, whereby the pocket forming panel 52 is brought into overlying relationship with the rear cover forming panel 32. Similarly, the structural reinforcement panels 62, 64 and the clasp 68 are brought into overlying relationship with the front cover forming panel 22. Prior to such folding the adhesive areas 56, 66 and **66*a* may be activated or, alternatively, a contact adhesive may be applied. Thus, the interior pocket forming panel 52 and structural panel 60 are fixed in the positions depicted in FIG. 2. The blank 20 may be supplied to a purchaser such as a film processor or a photographer, in the condition just described. FIG. 2 also depicts the steps an end user of the folder 10 undertakes having purchased the blank 20. Specifically, the release layer 50 protecting the adhesive region 49 along the spine 18 is removed by pulling it free in the direction of arrow E. The clasp tab 68 is lifted in the direction of arrow C, rupturing the nicks 86 holding it in place and reverse folding it 180 degrees outwardly to the position depicted in phantom in FIG. 2, its position before the structural panels were folded inwardly. Alternatively, if the nicks 86 are eliminated, the folder can be provided to the end user with the tab 68 in the position shown in FIG. 3**.

Figure 3:
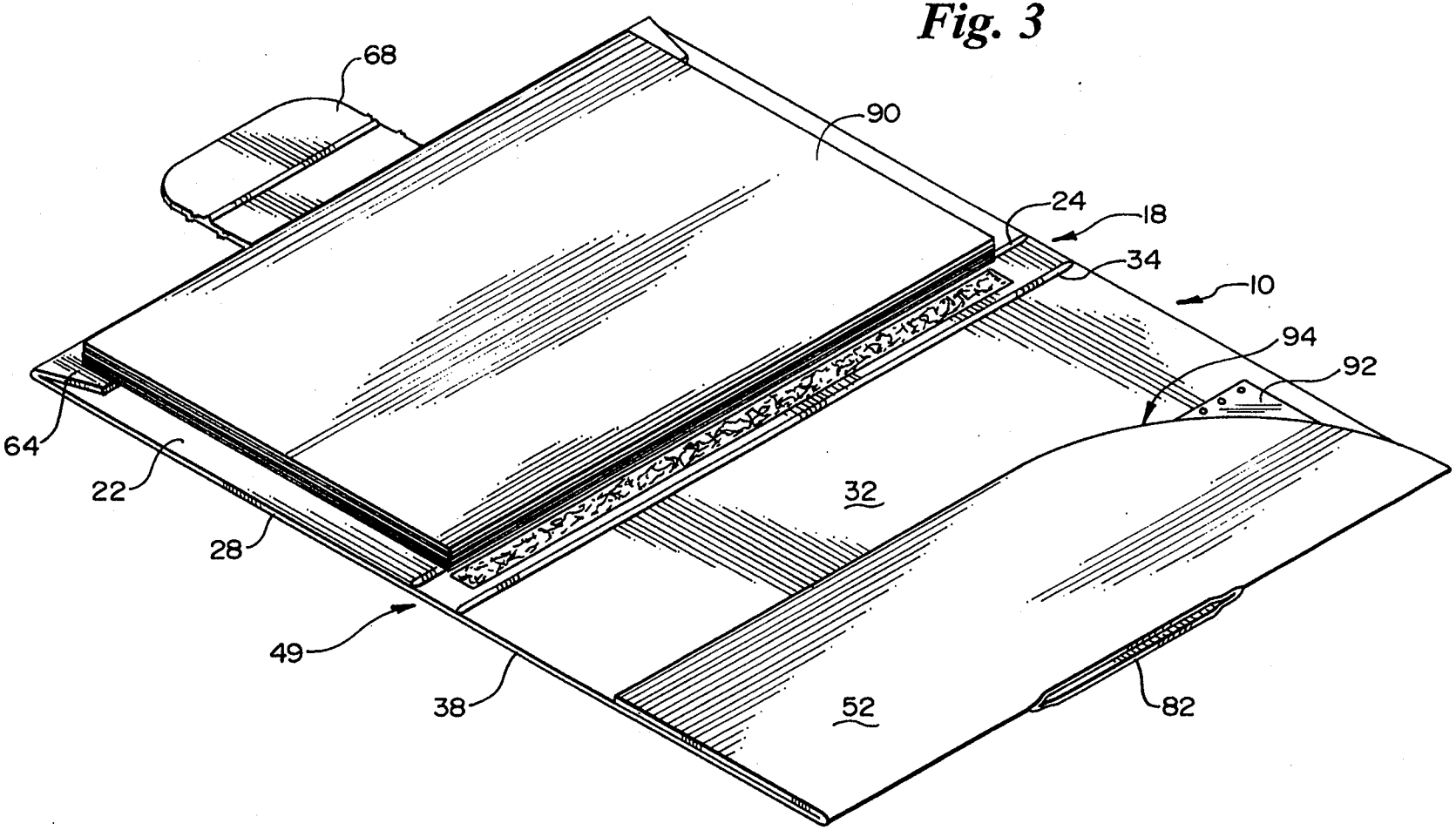
FIG. 3 is a perspective view of the present invention depicting the positioning of its intended contents, including the contents of the internal pocket.

FIG. 3 depicts the placement of a plurality of photographs or other sheet material 90 and some associated materials such as negatives 92 in the folder 10 of the present invention. The photographs 90 are arranged in a stack whereby they have a page-like appearance. The negatives or other materials are slidably received in the interior pocket 94. The folder 10, particularly the front and rear forming panels are folded toward each other about the fold lines 24, 34. This folding brings the edges 96 of the stacked photographs 90 into contact with the adhesive 48 affixing them in place against the adhesive. The clasp tab 68 can be folded in the direction of arrow D along the fold line 80 to facilitate the insertion of the free edge 74 into the slit 82. The fold line 80 also helps to create a secure grip, the span between the fold line 80 and 26 being substantially equal to the spine area between the fold lines 24 and 34. The clasp tab 68 is frictionally held within the slit 82 by contact with the inside surfaces of the pocket 94.

The present invention could be changed by changing the shape of the internal pocket 94 or the shape of the front and rear panels 14, 16, e.g., the corners thereof could be rounded. An additional pocket could be provided on the front cover by extending one or both of the structural panels 62, 64. Additionally, the folder 10 could be provided with interior or exterior graphics or designs.

Although the description of the preferred embodiment has been presented, various changes including those mentioned above could be made without deviating from the spirit of the present invention. It is desired, therefore, that reference be made to the appended claims rather than to the foregoing description to indicate the scope of the invention.

What is claimed is:

1. A folder for containing contents such as photographs and the like comprising:

a binding defined by two parallel side edges and two, spaced free edges generally perpendicular to said side edges;

a front cover foldably connected to one of the side edges and a rear cover foldably connected to the other of the side edges, each cover having a pair of free edges and an outer edge generally parallel to said side edges, each said pair of free edges of the covers including a first free edge generally collinear with one of the free edges of the binding and a second free edge generally collinear with the other free edge of the binding;

an adhesive means in said binder region for selectively securing, removing and resecuring the contents of said folder, said adhesive means including an adhesive portion and a release liner, said adhesive retaining sufficient adhesive strength throughout the life of the folder to facilitate said selective securing, removing and resecuring;

a selectively resealable closure including a closure tab foldably connected to one of the front and rear covers along a tab fold line adjacent to the outer edge of one of the front and rear covers and a closure tab receiving slit adjacent to the outer edge of the other of the front and rear covers; and an interior pocket foldably connected to the one of the front and rear covers with said closure tab receiving slit along a fold line generally co-extensive with the outer edge thereof.

2. The folder according to claim 1, said interior pocket being integral with the folder and foldably connected to the one of the front and rear covers with the closure tab receiving slit along a fold line generally collinear with the tab receiving slit.

3. The folder according to claim 1, wherein the closure tab includes a closure base and an adjacent closure flap foldably connected to the closure base along a flap fold line, said flap fold line being parallel to said tab fold line and said closure base being defined by the region between said flap and tab fold lines.

4. The folder according to claim 3, wherein the distance between said parallel edges and between said flap and tab fold lines is substantially equal.

5. A folder for containing contents such as photographs and the like comprising:

a binding defined by two parallel side edges and two, spaced free edges generally perpendicular to said side edges;

a front cover foldably connected to one of the side edges and a rear cover foldably connected to the other of the side edges, each cover having a pair of free edges and an outer edge generally parallel to said side edges;

a selectively reclosable closure including a closure tab foldably connected to one of the front and rear covers along a tab fold line adjacent to the outer edge of one of the front and rear covers and a closure tab receiving slit adjacent to the free edge of the other of the front and rear covers;

adhesive securing means carried by said binding for removably securing contents in the folder, said adhesive securing means including an adhesive portion and a removable release layer overlying the adhesive portion; and an interior pocket connected to one of the front and rear covers, said interior pocket being integral with the folder and foldably connected to the one of the front and rear covers with the closure tab receiving slit along a fold line generally collinear with the tab receiving slit, wherein a first free edge of the pair of free edges of the first and second covers defines at least a portion of the bottom of the folder, and wherein said pocket has an end edge generally parallel to the outer edge of the cover to which said pocket is connected, a bottom edge generally collinear with said first free edge of the cover to which said pocket is connected, and a curved edge extending between said end edge and a second free edge of the pair of edges of the cover to which said pocket is connected.

6. A blank for forming a folder for containing photographs or the like comprising:

a binding forming panel defined by two parallel fold lines and two spaced free edges generally perpendicular to the fold lines;

a first wall forming panel foldably connected to the binding forming panel along one of said two parallel fold lines and a second wall forming panel foldably connected to the binding forming panel along the other of said two parallel fold lines, each of said first and second wall forming panels having a pair of free edges and an outer edge generally parallel to the two parallel fold lines, each said pair of free edges of the first and second wall forming panels including a first free edge generally collinear with one of the free edges of the binding forming panel and a second free edge generally collinear with the other free edge of the binding forming panel; and a closure tab foldably connected to one of the first and second wall forming panels adjacent to the outer edge thereof, and a pocket forming panel foldably connected to the other one of the first and second wall forming panels along a fold line generally co-extensive with the outer edge thereof.

7. The blank according to claim 6, and a closure tab receiving cut along the foldable connection between the pocket forming panel and the one of the first and second wall forming panels to which the pocket forming panel is connected.

8. The blank according to claim 7, wherein the first free edge of the first and second wall forming panels defines at least a portion of the bottom of the folder formed from said blank, and wherein said pocket forming panel has an end edge generally parallel to the outer edge of the wall forming panel to which said pocket forming panel is connected, a bottom free edge generally collinear with said first free edge of the wall forming panel to which said pocket forming panel is connected, and a curved edge extending between said end edge and the second free edge of the wall forming panel to which said pocket forming panel is connected.

9. The blank according to claim 8 and adhesive means associated with the binding forming panel for selectively securing, removing and resecuring the photographs or the like in the folder.

10. The blank according to claim 9, wherein the closure tab is foldably connected to one of the first and second wall forming panels along a tab fold line and includes a closure base and a closure flap foldably connected to the closure base along a flap fold line, said flap fold line being parallel to said tab fold line and said closure base being defined by the region between said flap and tab fold lines, wherein the distance between said two parallel fold lines defining said binding forming panel and between said flap and tab fold lines is substantially equal.

* * * * *